US005222435A

United States Patent [19]

Theurer et al.

[11] Patent Number: 5,222,435

[45] Date of Patent: Jun. 29, 1993

[54] TRACK RENEWAL

[75] Inventors: Josef Theurer, Vienna; Manfred Brunninger, Altenberg; Friedrich Oellerer, Linz, all of Austria

[73] Assignee: Franz Plasser Bahnbaumaschinen-Industriegesellschaft m.b.H., Vienna, Austria

[21] Appl. No.: 925,505

[22] Filed: Aug. 5, 1992

[30] Foreign Application Priority Data

Sep. 10, 1991 [AT] Austria ..... 1799/91

[51] Int. Cl.[5] ..... E01B 29/00

[52] U.S. Cl. ..... 104/2; 104/15

[58] Field of Search ..... 104/2, 5, 7.1, 7.2, 104/9, 15

[56] References Cited

U.S. PATENT DOCUMENTS 3,633,513 1/1972 Plasser et al. .
3,795,056 3/1974 Plasser et al. ..... 104/7.1
3,807,310 4/1974 Erna et al. ..... 104/2
3,896,734 7/1975 Plasser et al. .
4,184,431 1/1980 Goel ..... 104/2
4,275,659 6/1981 Theurer et al. ..... 104/2
4,301,738 11/1981 Theurer ..... 104/2
4,542,697 9/1985 Cicin-Sain ..... 104/2
4,643,100 2/1987 Valditerra ..... 104/2

FOREIGN PATENT DOCUMENTS 3229878 3/1983 Fed. Rep. of Germany .
WO91/14470 11/1990 World Int. Prop. O. .

*Primary Examiner*—Mark T. Le
*Attorney, Agent, or Firm*—Collard & Roe

[57] ABSTRACT

A track is progressively renewed in an operating direction by continuously lifting the used track rails from the used ties, replacing the old ties by new ties and laying new rails on the new ties. Before the new rails are laid, adjoining ends thereof are continuously welded together behind the location where the ties are exchanged and the welded rails are exchanged for the used rails.

9 Claims, 1 Drawing Sheet

TRACK RENEWAL

BACKGROUND OF THE INVENTION

1. Field of the Invention

The present invention relates to a method of renewing a track comprised of two used rails fastened to used ties in an operating direction, which comprises the steps of continuously lifting the used rails off the used ties, continuously and sequentially replacing the used ties by new ties at a tie replacement track section progressing continuously in the operating direction, and continuously welding adjoining ends of new rail sections together to form endless welded rails and laying the endless welded rails on the new ties, and to a machine arrangement for carrying out this method, which comprises a plurality of mobile machine units each comprising machine frame means respectively carrying devices for lifting the used rails off the used ties and continuously and sequentially replacing the used ties by new ties and laying the endless welded rails on the new ties, and a device for welding adjoining ends of new rail sections together to form the new endless rails.

2. Description of the Prior Art

Patent application no. PCT/EP90/00819, published Nov. 29, 1990, under No. WO 90/14470 discloses a continuous track renewal wherein new rail sections to be laid on new ties are welded together immediately before they are laid. The welding station precedes the tie replacement in the operating direction of the track renewal, the endless welded rails being guided over the gap between the old and new tracks to be laid on the new ties. This has the disadvantage that the distance between the welding station and the rail laying station is quite large so that the artificially produced rail laying temperature can be maintained only by producing an excessively high temperature. This system requires a uniform rail laying speed which may be difficult to achieve because the tie and rail laying must be coordinated, and the tie replacing operation may encounter difficulties.

German Pat. No. 3,229,878, published Mar. 3, 1983, deals with the welding of adjoining ends of rail sections to form endless welded rails. This rail welding machine comprises a machine unit comprised of a series of successive machine frames and a rail transport car preceding the machine unit in the operating direction. The rail transport car is succeeded by a machine frame for raising the rail sections to the level of a welding head designed to weld adjoining ends of the rail sections together, and the welding head is transversely displaceable to enable it to weld both rails of the track. The endless welded rails are then pulled by a device following the welding head, and the endless welded rails are temporarily laid on the track behind the machine unit, for example centrally between the old rails, until the track is renewed by a succeeding track renewal train. This machine arrangement has the disadvantage that the endless welded rails must be temporarily stored on the old track, which makes cleaning of the ballast before the new track is laid impossible. Furthermore, the rails must be spread apart in the track renewal track to make the tie exchange possible and must then be moved together for laying at the desired track gauge.

U.S. Pat. No. 3,633,513, dated Jan. 11, 1972, discloses a work train for the continuous replacement of an old track by a new track, which comprises a plurality of independently movable machine frames respectively carrying tie and rail replacement devices.

U.S. Pat. No. 3,896,734, dated Jul. 29, 1975, discloses a similar track renewal train. This train includes a butt-welding head on one of the machine frames for butt-welding rail sections, temperature conditioning apparatus on succeeding machine frames for regulating the temperature of the continuous welded rails, and succeeding machine frames spaced a distance from the welding station for laying the temperature-conditioned continuous welded rails on the ties. This machine arrangement has the disadvantages described hereinabove in connection with WO 90/14470.

SUMMARY OF THE INVENTION

It is the primary object of this invention to improve a continuous track renewal method and machine arrangement so that the rail welding is more independent of the tie laying operation, which enables a substantially uniform rail laying temperature to be maintained.

This and other objects are accomplished according to one aspect of the invention with a method of renewing a track comprised of two used rails fastened to used ties in an operating direction, which comprises the steps of continuously lifting the used rails off the used ties, continuously and sequentially replacing the used ties by new ties at a tie replacement track section progressing continuously in the operating direction, and continuously welding adjoining ends of new rail sections together to form endless welded rails behind the progressing tie replacement track section in the operating direction and laying the endless welded rails on the new ties. This distances the tie replacement from the rail replacement, which is combined with the rail welding at the rail replacement station, which simplifies the operation and the machine structure. The distance between the welding station and the station at which the endless welded rails are laid is substantially shortened, which enables the temperature imparted to the rails by the welding operation to be substantially maintained until the endless welded rails are laid. Thus, in view of the short distance and even if there is a considerable difference between the required rail laying temperature and the ambient air temperature, the rails require only relatively minor temperature conditioning to be laid at the required temperature. The tie and rail replacement can be effected by independently movable machine units so that these operations will not interfere with each other.

According to another aspect of the present invention, a machine arrangement for carrying out this method comprises a first mobile machine unit comprising machine frame means carrying devices for lifting the used rails off the used ties and continuously and sequentially replacing the used ties by new ties, a second mobile machine unit trailing the first mobile machine unit in the operating direction and movable independently of the first mobile machine unit, the second mobile machine unit comprising machine frame means carrying devices for replacing the old rails by new rails, a rail transport car preceding the machine frame means of the second mobile machine unit for transporting the new rails, and a device for welding adjoining ends of new rail sections together to form endless new rails, the welding device preceding the device for replacing the rails. Such a two-part track renewal machine arrangement has the advantage that the tie replacement is spatially separated from the rail replacement so that the two operations cannot interfere with each other. This is of particular importance for the continuous rail welding operation since it enables the newly welded endless rails brought to the required laying temperature to be laid immediately and at a constant speed. In addition, the two-part machine arrangement enables the distance between the welding location and the rail laying location to be reduced to a minimum, thus making it possible to maintain the rail laying temperature constant even if the ambient temperature considerably differs therefrom. Finally, there are no new rails at the tie replacement location so that the tie replacement devices are more readily accessible and the structure is simplified.

Preferably, the used rails are laid on the new ties at a rail replacement track section after the used ties have been replaced by the new ties, the adjoining ends of the new rail sections are welded together at the rail replacement track section, the used rails are then lifted off the new ties, and the welded endless rails are then laid on the new ties. Laying the old rails on the new ties enables the rail transport car or cars and the machine frame carrying the welding device to be moved on the used rails and to lay the newly welded endless rails on the ties immediately after welding. The entire track renewal can be effectuated without any interference between the different operations because the tie and rail replacements are spatially separated from each other.

The welded endless rails may be brought to a desired laying temperature immediately before they are laid on the new ties, and if the distance between the welding location and the rail laying location corresponds about to the length of the new rail sections to be welded together, a high uniformity of the rail laying temperature may be obtained.

The machine frame means of the second mobile machine unit preferably comprises a machine frame arranged rearwardly of the rail transport car and preceding the rail replacing devices, the machine frame carrying a superstructure housing temperature conditioning means for heating and/or cooling the welded endless rails. This enables the welded endless rails to be laid on the new ties immediately after they have been temperature-conditioned, regardless of any difference in the required rail laying temperature and the ambient temperature. If the machine frame further carries a track preceding the superstructure and a gantry crane mounted on the track for movement between the rail transport car and the superstructure, the new rail sections may be readily and rapidly moved from the rail transport car towards the welding device. The superstructure preferably also houses the welding device, which may include two flash butt welding units spaced from each other transversely to the operating direction. In this way, the two endless track rails may be butt-welded parallel to each other to be laid at a uniform speed while maintaining the desired rail laying temperature.

According to a preferred embodiment, the machine frame means of the second machine unit comprises a bridge-shaped machine frame having opposite ends supported by undercarriages, and the devices for replacing the old rails by new rails comprise vertically and laterally adjustable devices mounted on the machine frame between the undercarriages for removing the used rails and laying the new endless welded rails on the new ties. This provides a neat grouping of the devices and enables them to operate without interference with each other so that the rails may be replaced in as short a section as possible. Preferably, the machine arrangement further comprises a temperature conditioning tunnel arranged to receive the endless welded rails, a forward end of the machine frame in the operating direction being connected to the tunnel. Such a temperature conditioning tunnel immediately preceding the rail laying location will be of particular advantage if the desired rail laying temperature differs considerably from the ambient air temperature.

BRIEF DESCRIPTION OF THE DRAWING

The above and other objects, advantages and features of this invention will become more apparent from the following detailed description of a now preferred embodiment thereof, taken in conjunction with the accompanying somewhat schematic drawing wherein.

DETAILED DESCRIPTION OF PREFERRED EMBODIMENT

Figures 1, 2, 3, 4:
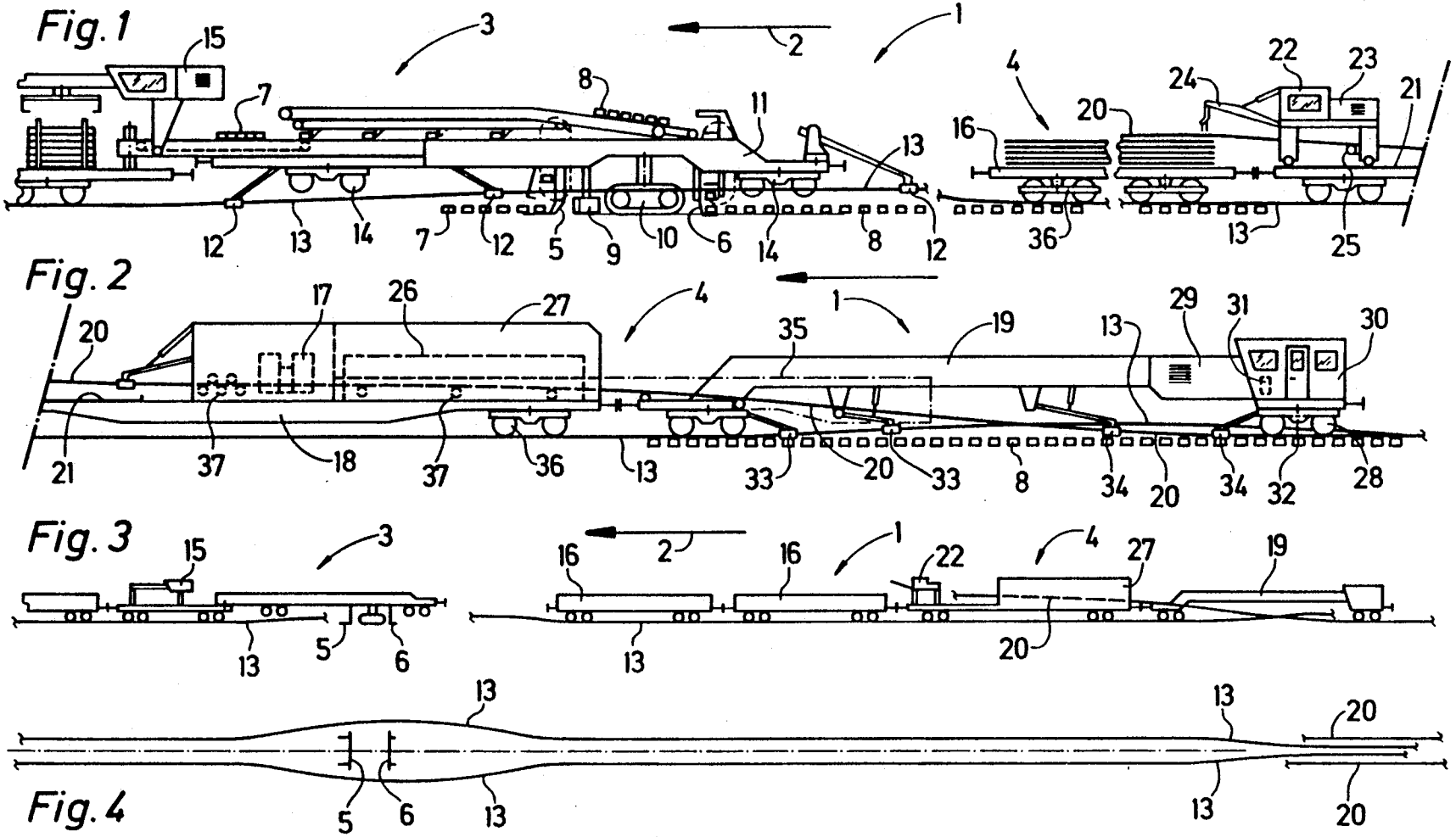
FIGS. 1 and 2 are side elevational views of the front and rear sections of a machine arrangement for continuous track renewal according to the invention.
FIG. 3 is a highly schematic and reduced side elevation of the machine arrangement of FIGS. 1 and 2.
FIG. 4 is a schematic top view of the track renewed by the machine arrangement.

Referring now to the drawing and first to FIGS. 1 and 2, there is shown machine arrangement 1 for continuously and progressively renewing a track comprised of two used rails 13 detached from used ties 7 in an operating direction indicated by arrow 2. The machine arrangement comprises first mobile machine unit 3 comprising machine frame 11 carrying devices 12 for lifting used rails 13 off used ties 7 and continuously and sequentially replacing used ties 7 by new ties 8. The tie replacing devices comprise device 5 for continuously receiving and lifting used ties 7 as machine unit 3 advances in the operating direction, and device 6 for continuously lowering and laying new ties 8. The used ties are lifted to a conveyor on machine frame 11 and removed thereby to a tie transport car preceding machine unit 3 in the operating direction, and the new ties are conveyed to device 6 by another conveyor mounted on the machine frame. In the gap between tie replacing devices 5 and 6, machine frame 11 is supported on the ballast by retractible caterpillar undercarriage 10, which is preceded by a vertically adjustable ballast plow for planing the ballast in the gap before new ties 8 are laid. Machine frame 11 further carries vertically and transversely adjustable guide devices 12 for raising and spreading used rails 13 so that the used ties may be removed and the new ties laid therebetween. Undercarriages 14 are mounted at respective ends of machine frame 11 and the undercarriages have wheels engaging the track rails so that the machine frame may be moved along the track during transit between track renewal sites when undercarriage 10 is retracted. A mobile gantry crane 15 is mounted on a forward end of machine frame 11 to transport used ties 7 to, and new ties 8 from, the preceding tie transport car from the machine frame. Such tie and rail replacement devices are well known in the art of continuous track renewal, as is the illustrated mounting and tie and rail conveyance.

As shown in the drawing, behind the gap between the old track and the new track, machine arrangement 1 comprises second mobile machine unit 4 trailing first mobile machine unit 3 in the operating direction indicated by arrow 2 and this trailing machine unit is movable independently of the first mobile machine unit.

Second mobile machine unit 4 comprises machine frames 18 and 19. Machine frame 19 carries devices 33, 34 for replacing old rails 13 by new rails 20. Machine frame 18 carries device 17 for welding adjoining ends of new rail sections together to form endless new rails 20, the welding device preceding the devices 33, 34 for replacing the rails. In the illustrated embodiment, machine frame 19 of second machine unit 4 is a bridge-shaped machine frame having opposite ends supported by undercarriages 28, and devices 33, 34 for replacing old rails 13 by new rails 20 comprise vertically and laterally adjustable rail guide rollers mounted on machine frame 19 between the undercarriages for removing used rails 13 and laying new endless welded rails 20 on new ties 8. Such rail replacement devices are well known in the art of track renewal and serve to lift and spread the used rails for removal thereof, and to lower the new rails to lay them on the ties at the proper gauge. Machine frame 19 carries central energy source 29 supplying power to the operating drives and operator's cab 30 equipped with central control 31 for the operating drives. The machine frame is propelled along the track by drive 32.

Rail transport car 16 supported on undercarriages 36 precedes machine frames 18, 19 of second mobile machine unit 4 for transporting new rail sections 20. These rail sections may have a length of 36 m, for example.

In the illustrated embodiment, machine frame 18 arranged between rail transport car 16 and machine frame 19 of second mobile machine unit 4 carries superstructure 27 housing temperature conditioning means 26, i.e. heating and/or cooling devices for regulating the temperature of welded new rails 20 passing therethrough. Machine frame 18 further carries track 21 preceding superstructure 27 and gantry crane 22 is mounted by guide rollers 25 on track 21 for movement between rail transport car 16 and superstructure 27 under the power of drive 23. The gantry crane has a vertically and transversely adjustable boom 24 for gripping new rail sections 20 and moving them to guide means, including roller conveyor 37, for directing the new rail sections to welding device 17 housed in superstructure 27. In the illustrated embodiment, the welding device includes two flash butt welding units spaced from each other transversely to the operating direction.

As shown in chain-dotted phantom lines in FIG. 2, temperature conditioning tunnel 35 is arranged to receive endless welded rails 20, and a forward end of machine frame 19 in the operating direction is connected to tunnel 35.

In the operation of track renewal machine arrangement 1, forward machine unit 3 is continuously advanced in the operating direction indicated by arrow 2 while used rails 13 are lifted by devices 12 off used ties 7 and are spread apart by these devices so that the used ties may be replaced by new ties 8 by devices 5 and 6, as schematically shown in FIG. 4. As also shown in this figure, the used rails are guided backwardly opposite to the operating direction and are temporarily laid on new ties 8 between new rails 20 so that undercarriages 36 and 28 of cars 16 and machine frame 19 may run without interference on the new rails.

Second machine unit 4, to which rail transport car 16 is coupled, is independently propelled by drive 32 and new rail sections are butt-welded at 17 to form endless welded rails 20 which are laid immediately after the welding on new ties 8 to replace the used rails. This involves transporting the new rail sections having a length of 36 m, for example, by means of gantry crane 22 to the two transversely spaced welding heads 17 where the rail sections are butt-welded to new endless rails 20. During the welding operation, the machine unit is stopped and, after welding, drive 32 is actuated to advance machine unit 4 to cause new endless rails 20 to be guided onto new ties 8 and to be laid on the new ties by devices 33, 34 at the proper gauge. After welding, the sections of new endless rails 20 pass through temperature conditioning devices 26 and temperature conditioning tunnel 35 to be heated or cooled to the desired rail laying temperature. While new endless rails 20 are laid on new ties 8 at the proper track gauge, old rails 13 are automatically moved towards each other so that they may be temporarily laid on the new ties between the newly laid new rails 1 FIG. 4). Thus, while undercarriages 36 of rail transport car 16 and machine frame 18 and front undercarriage 28 of machine frame 19 run on used rails 13, rear undercarriage 28 of machine frame 19 runs on new endless rails 20.

As soon as the front ends of new endless rails 20 have reached welding heads 17, the forward movement of machine unit 4 is stopped and gantry crane 22 is operated in the above-described manner to transport new rail sections 20 from transport car 16 to the welding heads and to align a rear end of each new rail section with the front end of a respective endless rail for butt-welding the rail sections to the endless rails 20. The welding at both rails 20 of the new track may be effected at the same time and both rails are temperature conditioned in superstructure 27 and tunnel 35.

The forward speed of second machine unit 4 is preferably so selected that its average speed, including the stop during welding, corresponds to the forward speed of continuously advancing first machine unit 3. The distance between welding location at device 17 and the location where new endless rails 20 are laid on new ties 8 substantially corresponds to the length of the new rail sections.

What is claimed:

1. A method of renewing a track comprised of two used rails fastened to used ties in an operating direction, which comprises the steps of (a) continuously lifting the used rails off the used ties, (b) continuously and sequentially replacing the used ties by new ties at a tie replacement track section progressing continuously in the operating direction, and (c) continuously welding adjoining ends of new rail sections together to form endless welded rails at a welding location behind the progressing tie replacement track section in the operating direction and laying the endless welded rails on the new ties at a rail laying location.

2. The track renewing method of claim 1, wherein the used rails are laid on the new ties at a rail replacement track section after the used ties have been replaced by the new ties, the adjoining ends of the new rail sections are welded together at the rail replacement track section, the welded endless rails are then laid on the new ties, and the used rails are then lifted off the new ties.

3. The track renewing method of claim 1, wherein the welded endless rails are brought to a desired laying temperature immediately before they are laid on the new ties, the distance between the welding location and the rail laying location being about the same length of the new rail sections to be welded together.

4. A machine arrangement for continuously and progressively renewing a track comprised of two used rails fastened to used ties in an operating direction, which comprises (a) a first mobile machine unit comprising machine frame means carrying (1) devices for lifting the used rails off the used ties and continuously and sequentially replacing the used ties by new ties, (b) a second mobile machine unit trailing the first mobile machine unit in the operating direction and movable independently of the first mobile machine unit, the second mobile machine unit comprising machine frame means carrying (1) devices for replacing the old rails by new rails, (c) a rail transport car preceding the machine frame means of the second mobile machine unit for transporting the new rails, and (d) a device for welding adjoining ends of new rail sections together to form endless new rails, the welding device preceding the devices for replacing the rails.

5. The machine arrangement of claim 4, wherein the machine frame means of the second mobile machine unit comprises a machine frame arranged rearwardly of the rail transport car and preceding the rail replacing devices, the machine frame carrying a superstructure housing temperature conditioning means.

6. The machine arrangement of claim 5, wherein the machine frame further carries a track preceding the superstructure and a gantry crane mounted on the track for movement between the rail transport car and the superstructure.

7. The machine arrangement of claim 5, wherein the superstructure also houses the welding device.

8. The machine arrangement of claim 4, wherein the machine frame means of the second machine unit comprises a bridge-shaped machine frame having opposite ends supported by undercarriages, and the devices for replacing the old rails by new rails comprise vertically and laterally adjustable devices mounted on the machine frame between the undercarriages for removing the used rails and laying the new endless welded rails on the new ties.

9. The machine arrangement of claim 8, further comprising a temperature conditioning tunnel arranged to receive the endless welded rails, a forward end of the machine frame in the operating direction being connected to the tunnel.

* * * * *